United States Patent [19]

Millen

[11] 3,985,361

[45] Oct. 12, 1976

[54] GAME DEVICE

[76] Inventor: Richard A. Millen, 34 Randall Ave., Rhinelander, Wis. 54501

[22] Filed: Jan. 15, 1975

[21] Appl. No.: 541,097

[52] U.S. Cl. ..... 273/134 AA; 273/141 R; 273/134 AC; 273/134 C; 273/134 E

[51] Int. Cl.[2] ..... A63F 3/00

[58] Field of Search ..... 273/134, 141, 142

[56] References Cited

UNITED STATES PATENTS

| | | | |
|---|---|---|---|
| 1,035,029 | 8/1912 | Meredith | 273/141 R UX |
| 1,538,134 | 5/1925 | Muir | 273/134 AA |
| 2,801,856 | 8/1957 | Medowar | 273/134 AB |
| 2,917,325 | 12/1959 | Sines | 273/141 R X |
| 2,990,181 | 6/1961 | Lippold | 273/134 AA |
| 3,037,773 | 6/1962 | Chambers et al. | 273/134 AA |
| 3,223,420 | 12/1965 | Turner | 273/134 AA |
| 3,533,628 | 10/1970 | Fisher | 273/134 AA |
| D210,034 | 1/1968 | Harvey | 273/134 AA UX |

FOREIGN PATENTS OR APPLICATIONS

| | | | |
|---|---|---|---|
| 1,249,898 | 11/1960 | France | 273/134 AT |
| 1,229,005 | 3/1960 | France | 273/134 AA |
| 1,526,893 | 4/1968 | France | 273/134 AE |
| 1,275,021 | 5/1972 | United Kingdom | 273/134 AA |

*Primary Examiner*—Delbert B. Lowe
*Attorney, Agent, or Firm*—Clarence A. O'Brien; Harvey B. Jacobson

[57] ABSTRACT

A game device embodying a game board having a planar playing surface having a path of movement for game pieces delineated thereon, a control spinner and directional cards positioned on the game board for controlling movement of the game pieces. The path of movement is divided into a plurality of increments or areas some of which are provided with instructional indicia. The game pieces simulate rockets and the game board, spinner, control cards and indicia relate to and are simulative of space travel.

1 Claim, 3 Drawing Figures

10
12
14
16
18
20
22
24
26
28
30
32
34
36
38
40
42
50
52
54
56
58
RETRO ROCKETS
FUEL CAPSULE
ROCKET FIRE
LAND-ING PAD
LAUNCH-ING PAD
BLAST-OFF
OVER-SHOT
LAND TO WIN
ROCKET REFUGE
GOOD 5 NEW 10 HIGH
RAPID ALERT HEAD FOR SUPER
RETRO ROCKET
ROCKET FIRE
BLAST-OFF
FUEL CAPSULE
ESCAPE PASS
FREE ORBIT
PLANET
RET-REXT
LAND ON MOON
MOON
JUPITER
NEP-TUNE
MERCURY
VENUS
MARS
UN-KNOWN

GAME DEVICE

BACKGROUND OF THE INVENTION

1. Field of the Invention

The present invention generally relates to a game device and more particularly a game board on which game pieces are movable along a path of movement delineated thereon under the control of a spinner and control cards with all of the components of the game device being simulative of space travel from a launching pad to various planets and safe return therby providing a game which is highly entertaining and stimulates interest in space travel and adventure.

2. Description of the Prior Art

Game devices employing game boards with paths of movement delineated thereon for movement of game pieces under control of a chance device are well known and game devices relating to space travel are also generally known as exemplified in prior art U.S. Pat. Nos. 2,976,045, 3,170,695, 3,389,913 and 3,223,420.

SUMMARY OF THE INVENTION

An object of the present invention is to provide a game device entitled "BLAST-OFF" which includes a game board having a unique path of movement delineated thereon for movement of game pieces in accordance with instructions and directions received from a spinner type chance control device and cards whereby the game pieces are moved from a starting point to a target area in a manner which will be entertaining, intriguing and educational, with all of the components of The game device being simulative of the entities and conditions which could be expected to be encountered during space travel.

Another object of the invention is to provide a game device in which the path of movement delineated on the game board includes designations of planets and alternative paths of movement some of which are shortcuts and some of which represent penalty situtations which must be followed as the game pieces land on certain areas of the path of movement under the control of the spinner and cards.

A further object of the invention is to provide a game device in accordance with the preceding objects which is relatively simple in construction and inexpensive to manufacture and will provide amusement for various age groups and will increase interest in and knowledge regarding space travel.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 3:
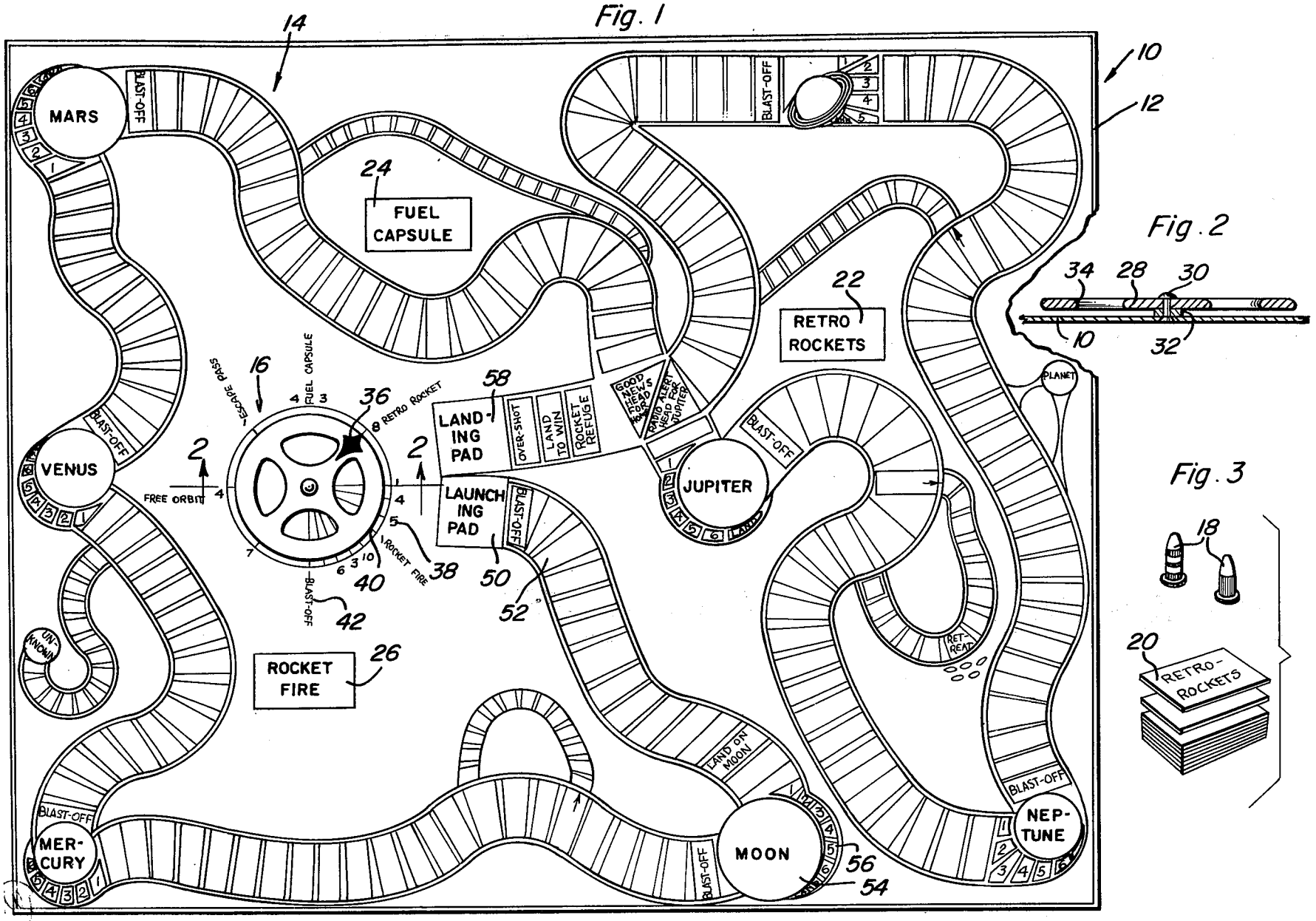
FIG. 1 is a plan view of the game board illustrating the path of movement delineated thereon.
FIG. 2 is a fragmental sectional view, on an enlarged scale, taken substantially upon a plane passing along section line 2—2 on FIG. 1 illustrating the construction of the spinner.
FIG. 3 is a group perspective view illustrating the game pieces and cards employed in the game device.

Referring now specifically to the drawings, the game board of the present invention is generally designated by reference numeral 10 and is of rectangular configuration and provided with a planar upper surface 12. The game board 10 may be constructed of any suitable material such as conventionally employed in game boards of this type such as heavy cardboard with a decorative surface provided thereon. If desired, the game board may be folded along a centerline to facilitate packaging and storage. The game board 10 is provided with a path of movement generally designated by the numeral 14 thereon and a spinner structure generally designated by numeral 16 which controls the movement of game pieces 18 along the path of movement 14. Rectangular cards 20 are provided and are positioned on three card stacks or storage areas 22, 24 and 26 formed on the planar surface of the game board 10.

The spinner structure 16 includes a generally circular disk 28 rotatably secured to the game board 10 by a central fastener 30 such as a rivet or the like with a spacer 32 being provided for slightly spacing the disk 28 from the planar surface 12 of the game board 10 so that the disk 28 can rotate in a substantially free manner about the fastener 30. The disk 28 is provided with a plurality of openings 34 extending therethrough which are generally oval-shaped in configuration and which define finger receiving holes by virtue of which the spinner may be rotated by engaging the finger in one of the holes and rapidly moving the finger in either direction against an edge of the hole for rotating the disk 28 about the center axis defined by the fastener 30. Disposed on the periphery of the disk 28 is an indicating arrow 36 which forms an indicator or an index line associated with numerical indicia 38 printed on the game board peripherally outwardly of the spinner with the numerical indicia being associated with radial lines 40, and in certain instances the numerical indicia are also provided with descriptive indicia 42. The numerical indicia is randomly arranged and includes the numerals 1–10 with the lower numerals being more frequently used than the higher valued numerals. At certain spaces around the periphery of the spinner, descriptive indicia 42 is used without any numerical indicia.

The cards 20 are separated into three groups having indicia on the obverse surface thereof corresponding with the three card storage or stacking areas on the game board which are designated "Retro Rockets," "Fuel Capsule," and "Rocket Fire." The face side of each of the cards is provided with instructional indicia indicating an action to be taken by the players such as moving a game piece ahead certain spaces, moving a game piece in a reverse direction a certain number of spaces or otherwise taking some action which may provide an advantage or disadvantage to a particular player.

The game pieces 18 are shaped to simulate a rocket or space capsule and have a generally flat base and pointed nose so that the game pieces may be moved along the game board and positioned on the path of movement.

In playing a game, each of the players choses a rocket which may be distinguishably colored or marked so that the player can recognize his game piece and the rockets are placed on the game board at a starting point of the path of movement designated by numeral 50 and which is provided with indicia designating this area as "Launching Pad." To designate the order of playing the spinner is rotated by each of the players with the player obtaining the highest number going first and the next highest going second. In order for a game piece to move from the launching pad to any space station, the spinner must indicate a number having descriptive indicia "Blast-Off." If desired, this provision may be eliminated for a shorter game. Each player spins the spinner only once for each turn and he moves his game piece the number of said incremental areas or spaces 52 indicated by the spinner. The path of movement includes planet areas 54 and areas 56 designated as orbit areas and provided with numeral indicia thereon. If the spinner indicates "Free Orbit," this will mean merely a pass if the player is not in an appropriate position but if the player's rocket is on the orbit numbers 56 around any of the planets, the player may immediately land his rocket on that planet. Each rocket must orbit if he doesn't land on a space 52 marked "Land on Planet" and a player cannot land if the number designated by the spinner is greater than the spaces left in the orbit numbers 56 to the land position. As the game progresses, each player spins the spinner which may be designated as a space station and moves his rocket the number of spaces indicated or follows instructions that may be provided by the spinner or by the cards. When landing on any area of the path of movement, the player must follow the instructions on that area or space if any before the next player takes his turn. If a player receives a card indicating "Escape Pass," this can only be used to enable that player to escape from a "Captured by Martians" situation which escape can also be accomplished by an order to exchange places with another ship or rocket. The "Pass" cards cannot be kept by the player and if he cannot use it he must put it back on the bottom of the stack of cards from which it was obtained. Any card indicating "By-Pass Planet" enables the game piece or rocket to move past the planet to the space marked "Planet By-Pass." When the rocket or game piece is in the area indicated "Rocket Refuge," no other rocket can be exchanged with it. When landing on any space marked "Rocket Fire," "Fuel Capsule," or "Retro Rockets," the top card in that stack must be taken and the obligations or rewards thereon must be fulfilled. Spaces marked "Good News," "Head for Home," and "Radio Alert, Head for Jupiter" must be counted as spaces when traveling in either direction and the rocket must obey written instructions of the space in which it has landed. That may allow the rocket from "Mars" to head for home and win, or the rocket from "Saturn" to have to go back around once more. The space marked "Land to Win" means that the rocket which lands on it moves to the landing pad 58 adjacent the launching pad

50 and this rocket becomes the winner. When landing on a space indicating "Over-shot," this rocket can only win by spinning a number 3 on the spinner.

By combining the spinner, cards and instructional indicia on the game board, additional advantages or penalties may be encountered by the players thus evening the chances of winning and the various indicia relating to space travel maintains a high degree of attention, amusement and entertainment.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A space travel simulating game device comprising a game board having a generally planar upper surface, a single segmental path of movement delineated on said surface by spaced side edge lines and transverse division lines, said path of movement being circuitous and irregularly curved and including a starting space defined as a launching pad and an end space defined as a landing pad and intermediate spaces defined as various planets and orbit areas for each planet, said launching pad and landing pad being disposed adjacent each other, said path of movement including numerical indicia associated with the spaces in each orbit area for controlling movement of the game pieces onto the planets, a plurality of game pieces of rocket shaped configuration movable along the path of movement, said path of movement including an intersecting portion adjacent the landing pad defined by two triangular areas provided with indicia to instruct game pieces landing thereon to proceed to the landing pad or proceed along a substantial portion of the path of movement, a plurality of stacks of instructional cards positioned on the game board, a spinner rotatably mounted on the game board adjacent the launching pad and landing pad, said spinner including a pointer associated with numerical indicia on the game board, for indicating the number of spaces to be moved by the game pieces of each player during his turn, said spinner being a circular disk having circumferentially spaced finger receiving openings therein, means rotatably mounting the circular disk on the game board, said game board having instructional indicia associated with the spinner for controlling the movement of the game pieces in combination with instructional indicia on certain areas of the path of movement and instructional indicia on the cards, said path of movement including bypass paths by which game pieces may bypass certain planets or take a longer route to the landing pad, one bypass path leading into a dead end space.

* * * * *